US005245724A

United States Patent [19]

Sacks

[11] Patent Number: 5,245,724

[45] Date of Patent: Sep. 21, 1993

[54] APPARATUS FOR WRINGING MOPS AND THE LIKE

[76] Inventor: Dieter Sacks, Moritzbergstr. 32, CH-8713 Uerikon, Switzerland

[21] Appl. No.: 730,496

[22] Filed: Jul. 16, 1991

[30] Foreign Application Priority Data

Jul. 21, 1990 [DE] Fed. Rep. of Germany ..... 4023219

[51] Int. Cl.[5] ..... A47L 13/144

[52] U.S. Cl. ..... 15/3; 15/262; 74/108; 74/506; 74/502.6; 74/502.4; 74/505

[58] Field of Search ..... 15/262, 260, 3; 100/171, 172; 68/248, 257, 262 R, 262 A, 262 B; 74/108, 505, 506, 502.6, 502.4

[56] References Cited

U.S. PATENT DOCUMENTS

| | | | |
|---|---|---|---|
| 1,185,780 | 6/1916 | Dumond | 68/248 |
| 1,557,828 | 10/1925 | Gould | 68/262 A |
| 1,787,441 | 1/1931 | Finnel | 15/262 |
| 1,823,486 | 9/1931 | Chase | 15/262 |
| 2,119,686 | 6/1938 | Pribyl | 15/262 |
| 3,441,973 | 5/1969 | Turk | 15/262 |
| 4,059,021 | 11/1977 | Spanel et al. | 74/108 |
| 4,704,763 | 11/1987 | Sacks et al. | 15/262 |
| 4,912,804 | 4/1990 | Pasbol | 15/262 |
| 4,928,505 | 5/1990 | Parks et al. | 100/172 |

FOREIGN PATENT DOCUMENTS

| | | | |
|---|---|---|---|
| 1014571 | 4/1983 | U.S.S.R. | 15/262 |

*Primary Examiner*—Harvey C. Hornsby
*Assistant Examiner*—Tony G. Soohoo
*Attorney, Agent, or Firm*—Peter K. Kontler

[57] ABSTRACT

Apparatus for wringing mops, sheets, strips or other wet commodities has a housing which can be placed on top of a bucket and contains a first roller and a second roller movable radially toward and away from the first roller. The mechanism for moving the second roller toward the first roller comprises a pivotable lever which can turn two sector-shaped collecting elements each connected to the trailing end of a discrete flexible elastic pusher the front end of which engages a bearing for the second roller. The pushers are confined to movement along selected paths while they push the second roller toward the first roller so that the rollers cooperate to expel moisture from a commodity between them at a rate which is determined by the selected position of the lever. The first roller can be driven to move a commodity between the rollers upwardly, and springs are provided to pull the second roller away from the first roller.

24 Claims, 3 Drawing Sheets

APPARATUS FOR WRINGING MOPS AND THE LIKE

BACKGROUND OF THE INVENTION

The invention relates to improvements in apparatus for wringing wet mops, wet strips, wet sheets and like moisture-containing commodities. More particularly, the invention relates to improvements in wringing apparatus of the type wherein the commodities to be relieved of moisture or excess moisture are caused to pass between two rollers or analogous wringing members.

It is already known to construct a wringing apparatus in such a way that one of the rollers is movable substantially radially of toward and away from the other roller and that at least one of the rollers can be rotated while a commodity is caused to advance between the rollers. The quantity of liquid which is expelled from a commodity depends on the selected width of the nip of the rollers. In accordance with a prior proposal, a wringing apparatus which is designed to expel moisture from leather sheets or strips and has means for transporting a sheet or strip between the two rollers. The means for moving one of the rollers toward the other roller includes one or more springs and a crank is provided to rotate the rollers in the course of a wringing operation. Such apparatus are not suitable for the wringing of mops, floor sweeping rags and like commodities.

In accordance with another earlier proposal, the wringing apparatus comprises a plate-like support for the commodity which is to be relieved of moisture or of excess moisture, and a roller which is caused to roll over the commodity on the plate-like support.

It was further proposed to provide a wringing apparatus with two plates at least one of which is movable toward the other plate to expel moisture from a mop between the two plates. The means for moving at least one of the plates toward and away from the other plate includes a rack and pinion drive. A drawback of such apparatus is that the toothed rack of the drive takes up a substantial amount of space because the rack is caused to move along a straight path in response to rotation of the pinion. Moreover, a rack and pinion drive is rather expensive and requires extensive maintenance, especially since its parts are likely to come in contact with water or another liquid which contains disinfectants, impurities and other often aggressive ingredients.

OBJECTS OF THE INVENTION

An object of the invention is to provide a novel and improved wringing apparatus which is simpler and less expensive than heretofore known apparatus.

Another object of the invention is to provide an apparatus which is less likely to injure the hand or hands or to catch the garment of an operator than heretofore known wringing apparatus.

A further object of the invention is to provide an apparatus which can be utilized for expulsion of moisture from a wide variety of commodities including mops, sheets, strips and many others.

An additional object of the invention is to provide the apparatus with novel and improved means for moving at least one of the wringing members relative to the other wringing member.

Still another object of the invention is to provide the apparatus with novel and improved means for rotating the wringing members.

A further object of the invention is to provide an apparatus which is more compact than heretofore known apparatus.

An additional object of the invention is to provide an apparatus which is designed to permit convenient immersion of a commodity to be treated into a body of liquid preparatory to expulsion of moisture.

Another object of the invention is to provide an apparatus wherein the expelled liquid can be collected in a simple and space-saving manner.

A further object of the invention is to provide a novel and improved method of transporting moisture-containing commodities in the course of a wringing operation.

Another object of the invention is to provide an apparatus wherein the rate of expulsion of moisture from a wet commodity can be selected, varied or maintained with a high degree of accuracy.

An additional object of the invention is to provide the apparatus with novel and improved means for driving the wringing members in a space-saving manner.

Still another object of the invention is to provide an apparatus which can be combined or used with, or which can embody, an available receptacle for a supply of cleaning liquid and/or for liquid which is expelled from a wet commodity.

A further object of the invention is to provide a cleaning and wringing apparatus which is sufficiently simple and sufficiently safe to ensure that its manipulation can be entrusted to semiskilled or even unskilled persons.

SUMMARY OF THE INVENTION

The invention resides in the provision of an apparatus for wringing mops and other wet commodities. The improved apparatus comprises a first rotary wringing member, a second rotary wringing member, means for rotating at least the first wringing member, and means for moving at least one of the wringing members relative to the other wringing member between a retracted position in which the wringing members permit a commodity to pass between them and an extended position in which the wringing members define a nip for and expel moisture from a commodity which is caused to pass between the wringing members in response to rotation of the first wringing member. The moving means comprises at least one elongated flexible pusher having a first portion at the at least one wringing member and a second portion, and at least one collecting element which is connected with the second portion of the at least one pusher and is rotatable in a first direction to collect the at least one pusher and to permit movement of the at least one wringing member to the retracted position, and in a second direction to pay out the at least one pusher whereby the at least one pusher moves the at least one wringing member to the extended position. The wringing members are preferably rotatable about substantially parallel axes, and the at least one wringing member is preferably movable substantially radially of the other wringing member. The apparatus preferably further comprises means for confining the at least one pusher to movement along a predetermined path, at least during rotation of the at least one collecting element in the second direction.

The at least one pusher can consist of an elastomeric material and stores energy during rotation of the at least one collecting element in the second direction. The at least one pusher stores energy by overcoming the resistance of the at least one wringing member to movement toward the extended position. In other words, that length of the elastic pusher which is disposed between its first and second portions undergoes some deformation (shortening) as a result of being compressed between the at least one wringing member and the collecting element, and the thus stored energy can overcome the resistance (if any) of the at least one wringing member to movement toward the extended position.

The confining means can comprise a shroud which is adjacent the at least one collecting element and overlies the collected pusher, i.e., that length of the pusher which extends from the second portion toward the first portion. The collecting element is preferably designed in such a way that it has an arcuate peripheral surface for collection of the at least one pusher, and the shroud is adjacent such peripheral surface, at least while the at least one collecting element rotates in the first direction. The aforementioned path includes an arcuate portion which is defined by the peripheral surface of the at least one collecting element, and a substantially straight portion which is defined by the shroud. The at least one rotary member can comprise or constitute a roller having a shaft and a bearing for the shaft, and the first portion of the at least one pusher preferably engages the bearing to move the bearing along the straight portion of the path in response to rotation of the at least one collecting element in the second direction.

The at least one collecting element can constitute at least a portion of a disc or wheel; for example, the at least one collecting element can constitute or resemble a sector.

The confining means can include the aforementioned shroud and/or a groove in the arcuate peripheral surface of the at least one collecting element. The groove receives the at least one pusher in the retracted position of the at least one wringing member. The depth of the groove is preferably sufficient to receive at least the major part of the at least one pusher between the first and second portions of the pusher in the retracted position of the at least one wringing member. The pusher-collecting portion of the at least one collecting element can extend along an arc of approximately 90°.

The at least one wringing member can comprise a roller, a shaft extending beyond each end of the roller, and a bearing for the shaft at each end of the roller. The moving means of such apparatus preferably comprises two collecting elements and two pushers each of which is connected with one of the two collecting elements and each of which engages one of the bearings.

The first wringing member can comprise a roller which is rotatable about a fixed axis (particularly a substantially horizontal axis), and the rotating means can comprise means for driving the roller. The apparatus further comprises a housing for the wringing members, for the rotating means and for the moving means. The rotating or driving means can comprise an electric motor and a portable source of electrical energy (such as one or more batteries) provided in or on the housing and in circuit with the motor. The means for completing the circuit can include a switch and a lobe on the at least one collecting element or on the at least one wringing member or analogous means for actuating the switch in response to movement of the at least one wringing member between its extended and retracted positions.

It is also possible to employ rotating means including a prime mover (such as an external rotor electric motor) in the first wringing member.

The apparatus preferably further comprises one or more springs or other suitable means for biasing the at least one wringing member to the retracted position, i.e., the at least one pusher must overcome the resistance of such biasing means in order to move the at least one wringing member to the extended position.

The rotating means is preferably designed to drive the first wringing member in a direction such that a wet commodity in the nip of the wringing members in the extended position of the at least one wringing member is caused to move upwardly in response to rotation of the first member.

The apparatus can be furnished with a liquid-confining receptacle (such as an open-top bucket of the type known as mop rolley, mop-bucket or driving mop-bucket). The housing can be positioned on the receptacle and preferably defines a passage which extends between the wringing members in the retracted position of the at least one wringing member and is sufficiently wide or large to permit movement of a wet commodity from and into the receptacle. The housing can be positioned onto the open top of the receptacle.

Still further, the apparatus can comprise means for intercepting moisture which is expelled from a commodity in the nip (in the extended position of the at least one wringing member and while the first member is driven by the rotating means). Such intercepting means can include a chute, a trough or a plate which is located beneath at least one of the wringing members to direct expelled moisture into the aforementioned receptacle.

The novel features which are considered as characteristic of the invention are set forth in particular in the appended claims. The improved wringing apparatus itself, however, both as to its construction and its mode of operation, together with additional features and advantages thereof, will be best understood upon perusal of the following detailed description of certain presently preferred specified embodiments with reference to the accompanying drawing.

DESCRIPTION OF PREFERRED EMBODIMENTS

Figure 1:
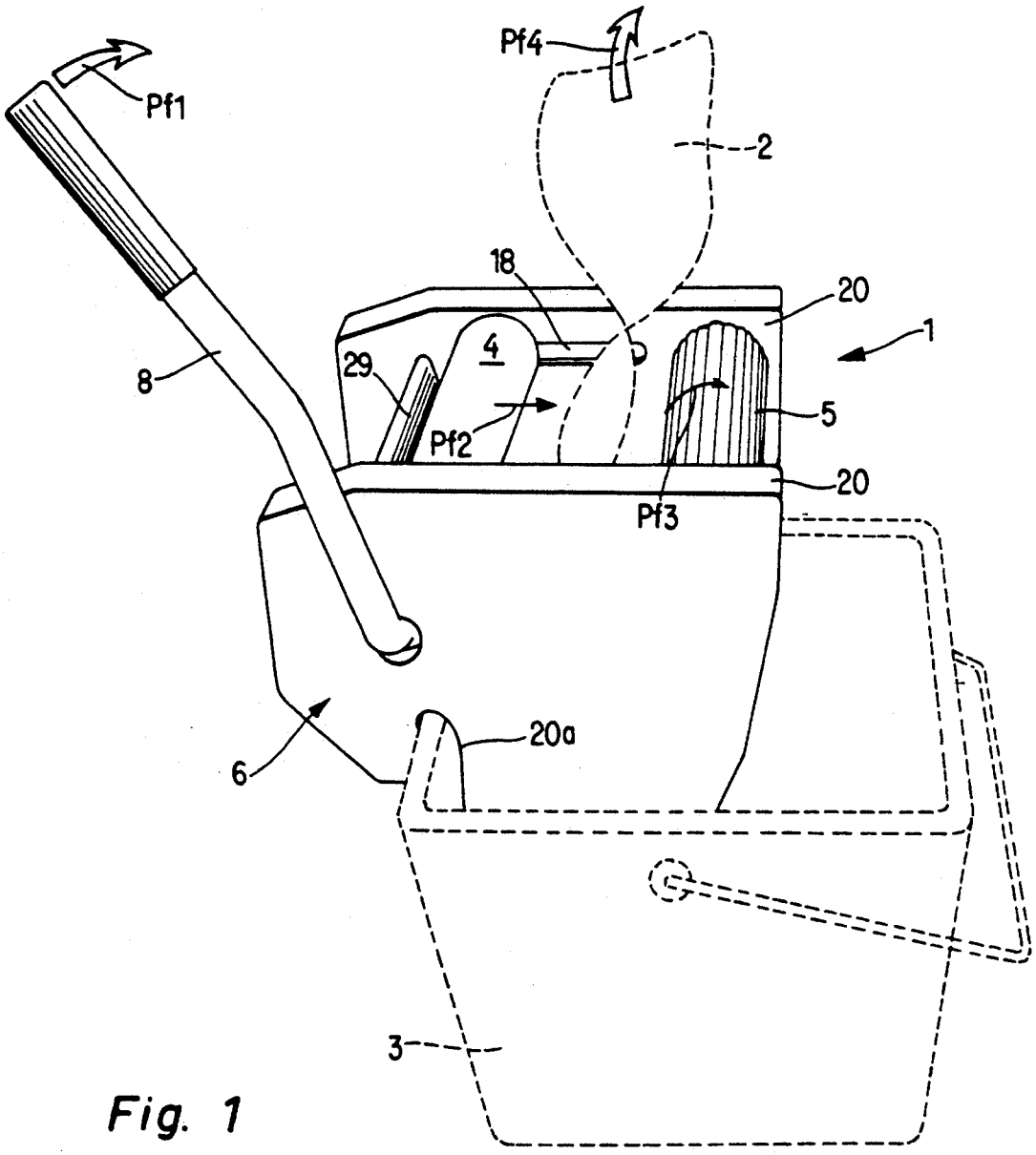
FIG. 1 is a perspective view of an apparatus which embodies one form of the present invention, the housing of the apparatus being positioned on the open top of a receptacle in the form of a bucket which is indicated by broken lines.

The wringing apparatus 1 which is shown in FIG. 1 is designed to expel moisture, or to expel some moisture, from elongated strips or sheets (one indicated by a broken line), mops or other wet or moist commodities 2. The apparatus 1 comprises a housing 6 which can be positioned on the open top of a receptacle 3 (indicated by broken lines) here shown as a standard mop rolley, also called mop-bucket or driving mop-bucket. The sidewalls or cheeks 20 of the housing 6 are provided with notches 20*a* for reception of a portion of the rim around the open top of the receptacle 3. The notches 20a are positioned in such a way that the major part (including the center of gravity) of the apparatus 1 overlies the open top of the bucket 3. The latter can contain a supply of liquid (e.g., clean water or water which contains a suitable disinfectant) which can be used for washing or rinsing of soiled sheets, mops or other commodities 2 prior to start of the wringing operation. The bucket 3 collects the liquid which is expelled from a freshly cleaned and/or disinfected commodity 2 in the course of the wringing operation.

The apparatus 1 comprises two rotary wringing members 4, 5 each of which includes a roller between the sidewalls or cheeks 20 of the housing 6. The member 5 is rotatable about a fixed horizontal axis which is defined by the housing 6, and the member 4 is movable substantially radially of toward and away from the member 5 in and counter to the direction which is indicated by arrow Pf2. The arrow Pf1 indicates the direction of manual pivoting of a handle or lever 8 which forms part of the means (7, shown in FIG. 2) for moving the member 4 between a retracted position (shown in FIGS. 1 and 4) and an extended position (shown in FIG. 3). The arrow Pf3 indicates the direction of rotation of the member 5, by a prime mover 9 (FIG. 2) in the housing 6, and the arrow Pf4 indicates the direction of (upward) movement of the commodity 2 in the course of the wringing operation.

Figure 2:
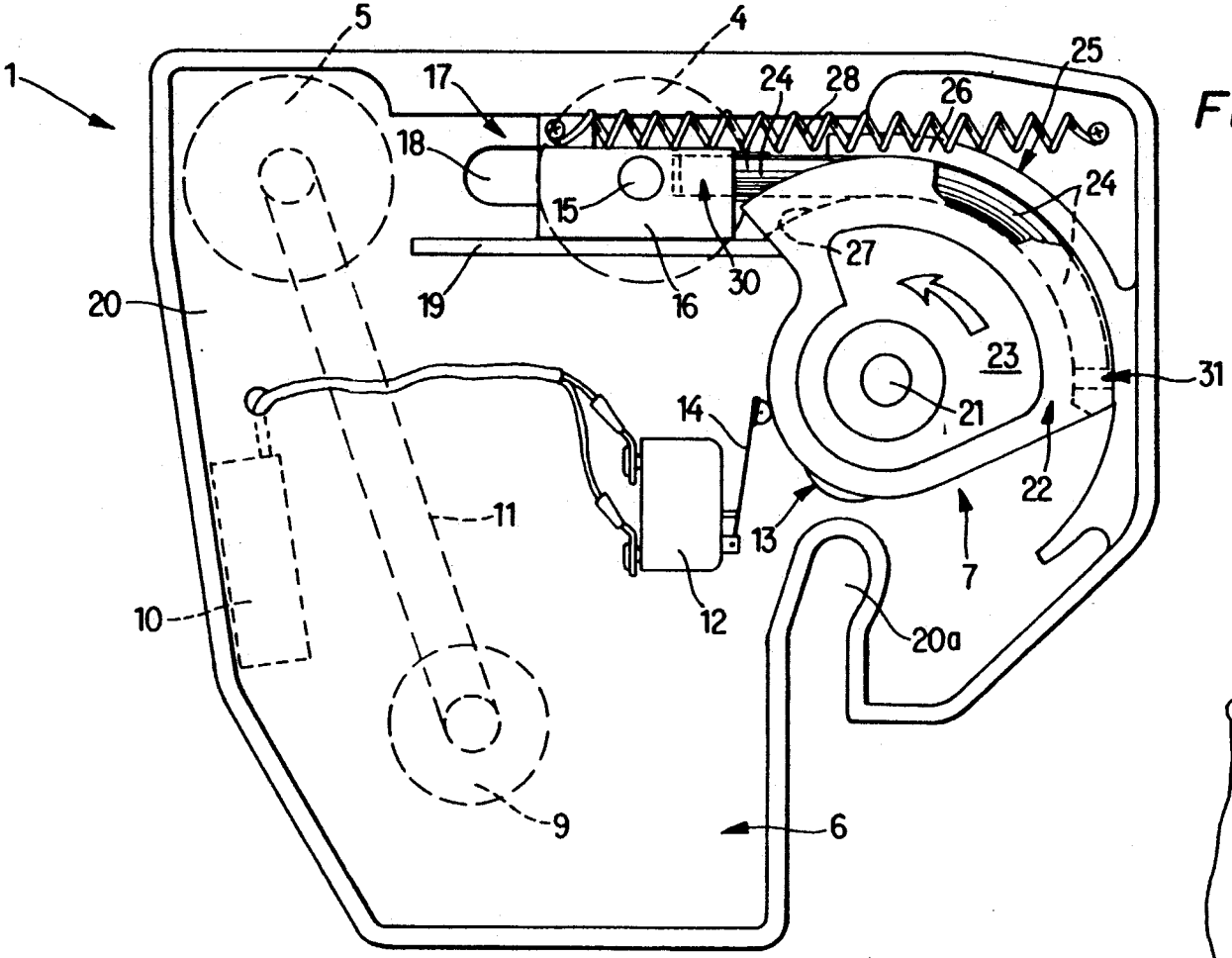
FIG. 2 is an enlarged side elevational view of the apparatus, with the bucket and the front wall of the housing and the lever of the moving means omitted.
Figure 3:
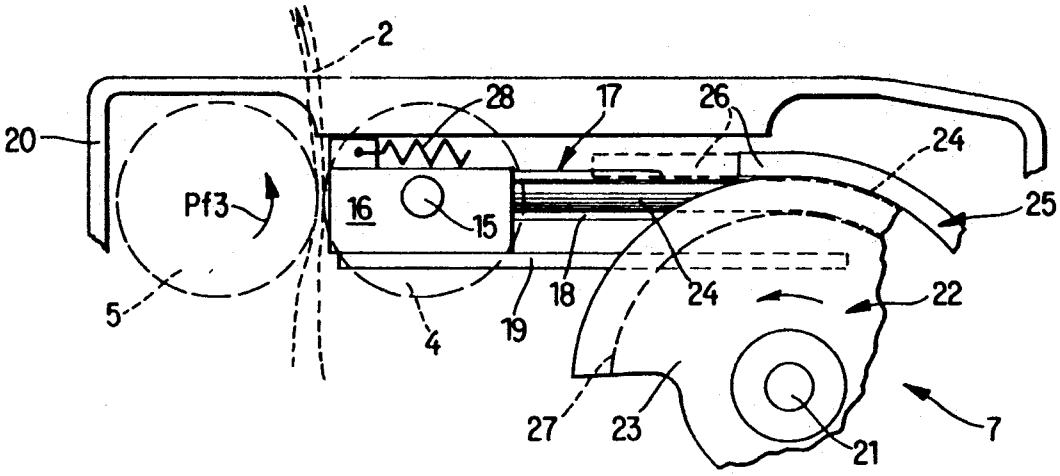
FIG. 3 illustrates a detail in the structure of FIG. 4, with the mobile wringing member shown by broken lines in the extended position.
Figure 4:
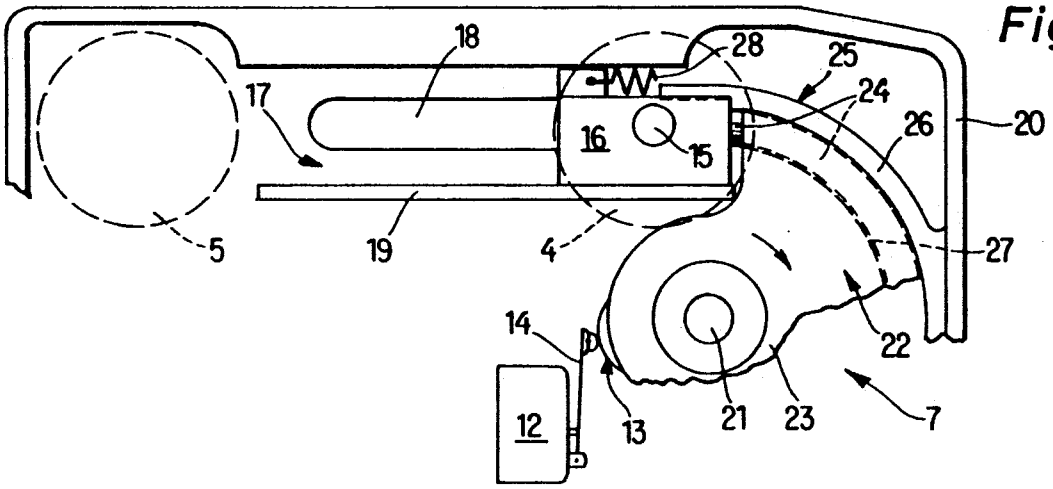
FIG. 4 shows the structure of FIG. 3 but with the mobile wringing member in the retracted position.

When the member 4 is maintained in the retracted position of FIGS. 1 and 4, the housing 6 defines a substantially vertical passage which extends between the members 4, 5 and is wide enough to facilitate convenient introduction of a commodity 2 between the sidewalls 20 and into the body of liquid in the bucket 3 so that the commodity can be washed and/or rinsed prior to start of the wringing operation which begins in response to pivoting of the lever 8 in the direction of arrow Pf1. Such pivoting of the lever 8 entails completion of the circuit of the motor 9 so that the member 5 is rotated in the direction of arrow Pf3 and rotates the member 4 through the medium of the commodity 2 which is thereby caused to move upwardly (arrow Pf4) and is relieved of moisture or of a desired percentage of moisture, depending on the extent of pivoting of the lever 8 in the direction of arrow Pf1. The commodity 2 moves upwardly in the nip which is defined by the members 4, 5 when the member 4 is moved to the extended position of FIG. 3. FIG. 2 shows the member 4 in a partly extended position.

In addition to the lever 8, the moving means 7 comprises two elongated flexible pushers 24 (located behind each other in each of FIGS. 2–4) and two rotary collecting elements 22 (located behind each other in each of FIGS. 2–4), one for each of the pushers 24. The pushers 24 serve to move the bearings 16 for the shaft 15 of the roller of the wringing member 4 toward the member 5 when the lever 8 is pivoted in the direction of arrow Pf1. This lever is connected with and can rotate a shaft 21 which is parallel to the axes of the members 4, 5 and is journalled in the sidewalls 20 of the housing 6. Still further, the moving means 7 comprises one or more coil springs 28 which are connected to the bearings 16 and to the respective sidewalls 20 to permanently bias the member 4 toward the retracted position of FIGS. 1 and 4. Other types of biasing means can be used with equal or similar advantage. The extent of angular movement of the lever 8 in the direction of arrow Pf1 (against the opposition of the spring or springs 28) will determine the width of the nip of the members 4, 5 and hence the extent to which these members expel moisture from a commodity 2 which is caused to move upwardly (arrow Pf4) because, at such time, the motor 9 drives the member 5 in the direction of arrow Pf3. As mentioned above, the upwardly advancing commodity 2 rotates the roller of the member 4 when the latter is maintained in the extended position. Adjustability of the extent of movement of the member 4 from its retracted position toward the foremost extended position is desirable and advantageous because the person in charge of manipulating the lever 8 can determine the extent of demoisturizing of the commodity 2. For example, it is often desirable to expel a very high percentage of moisture, e.g., when a freshly wrung mop is to collect water off a floor. On the other hand, it might be desirable to expel only a certain percentage of moisture, for example, when the commodity 2 has been immersed into a body of liquid which contains a disinfectant and such disinfectant is to be transferred onto a floor.

An advantage of the feature that the motor 9 can drive the wringing member 5 in the direction of arrow Pf3 (in order to move a commodity 2 upwardly as indicated by arrow Pf4) is that this is often more convenient to the operator who is about to use the partially or substantially demoisturized commodity to sweep a floor, a piece of furniture or another object. In addition, such mode of rotating the member 5 is safer than if the commodity were to be transported downwardly because the person in charge is less likely to have her or his fingers or a piece of her or his garment caught in the nip of the members 4, 5. Still further, the just described mode of rotating the member 5 ensures that the freshly washed or rinsed or disinfected commodity 2 does not descend into the body of liquid in the bucket 3.

The motor 9 is an electric motor which is installed between the sidewalls 20 of the housing 6 and is in circuit with a portable energy source 10, preferably including one or more replaceable batteries mounted on one of the sidewalls 20. The circuit of the motor 9 (which is connected with the roller of the wringing member 5 by a belt or chain transmission 11) can be completed by an electric switch 12 which is installed in the housing 6 and has a follower or trip 14 actuatable by a lobe 13 on one of the collecting elements 22. The switch 12 completes the circuit of the motor 9 (to set the member 5 in motion) when the follower 14 is not engaged by the lobe 13, namely, when the member 4 is in the process of moving toward the extended position of FIG. 3, i.e., toward the member 5. If desired, the switch 12 can be positioned to be actuated (to complete the circuit of the motor 9) in response to engagement of the follower 14 by one of the bearings 16 or by any other part which is in motion during movement of the member 4 toward the member 5. All that counts is to ensure that the member 5 is rotated not later than when a wringing operation is to begin, i.e., when the nip of the members 4, 5 is sufficiently narrow to ensure that at least some moisture will be expelled from successive increments of the ascending moisture-containing (wet) commodity 2.

The motor 9 is preferably mounted at a level below and at a considerable distance from the member 5. This ensures that the portion of the apparatus which overlies the bucket 3 is relatively heavy and the bucket is not upturned even in response to the application of a substantial force acting in a direction to pivot the lever 8 clockwise, as viewed in FIG. 1.

Figure 5:
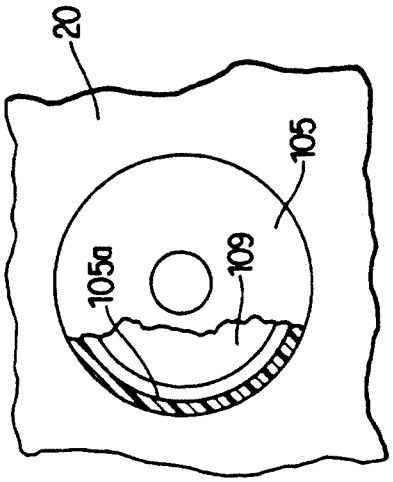
FIG. 5 shows a detail of a modified apparatus.

It is equally within the purview of the invention to enhance the compactness of the improved wringing apparatus by installing the prime mover in, rather than adjacent, the driven wringing member 5. This is shown in FIG. 5 wherein the rotary wringing member 105 is provided with a sealable internal chamber 105*a* for an electric motor 109, preferably an external or outside rotor motor) which is connected in circuit with an energy source (not shown) in any well known manner and can be started to rotate the member 105 in the direction of arrow Pf3. The chamber 105*a* can extend along a portion of or all the way between the axial ends of the wringing member 105. The energy source for the motor 109 can be installed in the chamber 105*a*.

The roller of the wringing member 4 is an idler roller, and the shaft 15 has stubs which extend beyond both axial ends of the idler roller and each of which is received in a discrete bearing 16 shiftable in and counter to the direction of arrow Pf2 toward and away from the roller of the member 5 which is rotatable about a fixed axis. Such axis is at least substantially horizontal when the housing 6 is properly mounted on the bucket 3. The bearings 16 are reciprocable in straight guides 17 which are provided at the inner sides of the sidewalls or cheeks 20 of the housing 6 and confine the member 4 to reciprocatory movements in and counter to the direction of arrow Pf2. The member 4 will move counter to the direction of arrow Pf2 when the lever 8 is released so that the spring or springs 28 are free to dissipate energy. The guides 17 include grooves 18 which are provided in the inner sides of the sidewalls 20 and elongated rails 19 which are provided on the sidewalls 20 in parallelism with and at a level below the respective grooves 18.

The collecting or gathering elements 22 of the moving means 7 include sector-shaped components 23 with arcuate peripheral surfaces extending along arcs of approximately 90°. Each of the components 23 preferably constitutes a portion of a disc, wheel or pulley which is affixed to the shaft 21 for the lever 8. The illustrated apparatus 1 is or can be designed in such a way that the lever 8 must be turned through an angle of approximately or exactly 90° in order to move the wringing member 4 from the retracted position of FIG. 4, through the partly extended position of FIG. 2, and to a fully extended position (FIG. 3) at a minimum distance from the member 5.

Each pusher 24 has a first portion which engages the member 4 by extending into a socket 30 in the respective bearing 16, and a second portion 31 which is remote from the first portion and is preferably affixed to the periphery of the respective component 23. A substantial part of each pusher 24 is collected or gathered by (convoluted on) the respective component 23 in the retracted position of the member 4. This can be seen in FIGS. 2 and 4. In fact, each pusher 24 can be fully convoluted onto the respective component 23 so that only its first or front portion continues to extend into the socket 30 of the respective bearing 16. An advantage of pushers which can be convoluted onto rotary collecting elements 22 is that the moving means 7 occupies a relatively small amount of space. This is in contrast to aforediscussed conventional wringing apparatus wherein the means for moving one of the wringing members relative to the other wringing member comprises a rack and pinion drive with a reciprocable rack which moves back and forth in response to rotation of the pinion.

The moving means 7 further comprises means (25) for confining the flexible elongated pushers 24 to movement along accurately determined paths to thus ensure that the member 4 can be moved toward the member 5 in a predictable and reproducible manner. Confinement of the pushers 24 to movement along predetermined paths is particularly important during movement of the member 4 from the retracted position of FIG. 4, i.e., when the pushers 24 are caused to push the respective bearings 16 along the respective guides 17 so that the roller of the member 4 advances toward the member 5. The illustrated confining means 25 comprises two partially arcuate and partially straight shrouds 26 (one concealed behind the other in each of FIGS. 2–4) which are adjacent the peripheral surfaces of the respective components 23 and compel the adjacent pushers 24 to perform a particular type of movement during each pivoting of the lever 8 in the direction of arrow Pf1. The shrouds 26 can form integral parts of the respective sidewalls 20 or can constitute separately produced parts which are bonded, riveted or otherwise secured to the adjacent sidewalls, and their straight portions can extend toward the respective bearings 16 (note the broken lines in FIG. 3) to prevent buckling of the flexible pushers 24 between the sockets 30 and the corresponding components 23. The curvature of arcuate portions of the shrouds 26 preferably matches or closely approximates the curvature of peripheral surfaces of the adjacent components 23.

In order to further reduce the likelihood of any stray movements of the pushers 24 during advancement of the member 4 to the extended position of FIG. 3, the confining means 25 preferably further comprises arcuate grooves 27 which are machined into or otherwise formed in the peripheral surfaces of the components 23 and are or can be sufficiently deep to receive the entire adjacent portions of the respective pushers 24. If the pushers 24 have a substantially circular cross-sectional outline, the depth of each groove 27 can equal or approximate the diameter of the respective pusher. The surfaces bounding the grooves 27 prevent any lateral flexing or buckling of the pushers 24 while the pushers are in the process of storing energy and of thereupon pushing the respective bearings 16 (i.e., the member 4) toward the member 5. Those portions of the pushers 24 which are received in the respective grooves 27 and are overlapped by the adjacent shrouds 26 and are thus compelled to follow accurately determined paths which, as mentioned above, is particularly important during movement of the member 4 from the retracted position of FIG. 4. When the lever 8 is pivoted counter to the direction of arrow Pf1 (back to the angular position of FIG. 1), the components 23 pull the respective pushers 24 and cause the pushers to become convoluted in their grooves 27. At the same time, the springs 28 pull the respective bearings 16 in a direction away from the member 5 so that the first or front portions of the pushers 24 remain in the respective sockets 30 even if such front portions are not positively connected to the respective bearings. Those portions of the shrouds 26 which are straight and extend from the peripheral surfaces of the respective sector-shaped components 23 toward the associated bearings 16 hold the non-convoluted portions of the pushers 24 in optimum positions for transmission of necessary forces to the bearings 16 and hence to the member 4 to thus ensure that the members 4, 5 expel moisture from a commodity 2 at a rate which has been selected by the angular position of the lever 8.

The depth of the grooves 27 can be reduced to less than the diameter of a pusher 24, especially if the shrouds 26 have concave internal surfaces so that they resemble arcuate troughs which overlie the exposed portions of the pushers adjacent the respective grooves 27.

The confining means 25 renders it possible to make the pushers 24 from a flexible elastomeric material which can be compressed to store energy during turning of the components 23 in a direction to pay out or dispense the respective pushers (i.e., in a counterclockwise direction, as viewed in FIG. 3) and, once adequately compressed, the pushers can predictably maintain the member 4 at a selected distance from the member 5. In addition, the elastically deformable pushers 24 ensure that the member 4 can yield and temporarily moves away from the member 5 if the commodity 2 between the members 4, 5 contains or carries a hard object or a hard portion which could not pass between the members 4, 5 except if one of these members were to yield in order to increase the width of the nip for the ascending commodity.

It is presently preferred to make the pushers 24 of a material which ensures that the pushers can be flexed and can straighten out during winding onto and during unwinding off the respective components 23, and which is at least slightly elastic to enable the member 4 to yield by temporarily moving away from the member 5, when necessary. It is further preferred to design the pushers 24 in such a way that they tend to remain straight which also contributes to more predictable advancement of the bearings 16 toward the member 5 when the components 23 are rotated in a sense to pay out the convoluted portions of the pushers. If the tendency of the pushers 24 to remain straight is very pronounced, at least a portion of the confining means 25 can be omitted; for example, it might be possible to omit the shrouds 26, to shorten these shrouds or to omit the grooves 27 in the peripheral surfaces of the collecting elements 23. Nevertheless, at least a portion of the confining means 25 will preferably remain in order to further reduce or eliminate the likelihood of any stray movements of intermediate portions of the pushers 24 while the pushers are called upon to move the member 4 toward the member 5 and to exert a force which is needed to achieve a desired or selected moisture expelling action.

At the present time, the pushers 24 are preferably made of a suitable elastomeric plastic material. However, it is equally possible to employ pushers in the form of coil springs or to employ pushers which include coil springs embedded, at least in part, in an elastomeric plastic material.

The front portions of the pushers 24 can be more or less permanently secured to the respective bearings 16. For example, the pushers 24 can be glued to the surfaces bounding the respective sockets 30. The peripheral surfaces of the components 23 can be provided with sockets (e.g., with radially extending blind bores) for reception of the second portions 31 of the respective pushers 24. The second portions 31 can be glued or otherwise secured to the surfaces bounding the sockets in the peripheral surfaces of the components 23.

The springs 28 constitute optional but desirable parts of the moving means 7 in the improved wringing apparatus. These springs ensure that the member 4 is automatically returned to the retracted position of FIG. 4 (and that the lever 8 automatically returns to the position of FIG. 1) as soon as the application of force to the lever (in the direction of arrow Pf1) is reduced or terminated.

An important advantage of the improved apparatus is that the wringing member 4 can perform long strokes between its retracted and fully extended positions without contributing to the bulk of the apparatus. Thus, when permitted to assume the retracted position of FIG. 4, the member 4 cooperates with the member 5 to define a rather large passage for convenient introduction of a commodity 2 into the body of liquid in the bucket 3. Moreover, once the immersion of a commodity 2 into the body of liquid is completed (either for the purpose of washing, for the purpose of rinsing or for the purpose of impregnating with a disinfectant or another agent), the thus treated commodity need not be further manipulated (e.g., shifted or transferred) prior to start of the wringing operation. All that is necessary is to ensure that the upper end portion of the commodity 2 extends between the members 4, 5 before the lever 8 is pivoted in the direction of arrow Pf1 to start the motor 9 or 109 and to move the member 4 closer to the member 5 so that the expulsion of moisture at a selected rate can begin.

The passage between the members 4, 5 (in retracted position of the member 4) can be so large that a handle or another part of an implement which includes or carries the commodity 2 can also extend through the housing 6 and toward the open top of the bucket 3 so that the entire commodity can be adequately washed, rinsed and/or otherwise treated prior to start of the wringing operation. This is desirable and advantageous because a commodity 2 which is about to be immersed in the body of liquid in the bucket 3 need not be detached from the implement which is used to move such commodity in the course of a floor sweeping or other cleaning operation. Thus, the wringing step can be completed rapidly and the operator need not touch the soiled commodity which is to be washed, rinsed and/or otherwise treated prior to wringing it between the members 4 and 5.

FIG. 1 further shows an intercepting device 29 which is adjacent and extends beneath the wringing member 4 to direct expelled moisture into the bucket 3 in the course of a wringing operation. The intercepting device 29 can constitute a trough, a plate, a sheet or any other suitable part which may but need not share the reciprocatory movements of the member 4 as long as it ensures that moisture which is being expelled from a commodity in the nip of the members 4, 5 will return into the bucket 3. A similar intercepting device can be installed (if necessary) adjacent and beneath the wringing member 5.

The improved apparatus can be used for wringing of a variety of moisture collecting commodities, including mops with strands, pieces of cloth, pieces of leather, sponges, strips of foamed material and/or others. The commodities may but need not be detached from the remaining parts of cleaning implements preparatory to passage through the housing 6 (between the members 4, 5) and into the body of liquid in the bucket 3.

The moving means 7 of the improved wringing apparatus is simple, compact and inexpensive. Damaged, worn or aged pushers 24 can be replaced with little loss in time, the same as spent batteries 10 for the motor 9 or 109. The feature that the pushers 24 can be stored by convoluting them in the grooves 27 of the respective sector-shaped components 23 contributes significantly to compactness of the wringing apparatus. In addition, the pushers 24 are protected by being concealed at all times except during those relatively short intervals when a wet commodity is caused to pass upwardly (arrow Pf4) in response to rotation of the wringing member 5 or 105 in the direction of arrow Pf3. Thus, the housing 6 need not be enlarged for the express purpose of providing room for the pushers 24 in the retracted position of the wringing member 4.

The shrouds 26 can be of one piece or each of these shrouds can be assembled of two or more parts, e.g., of a plurality of pin- or stud-shaped members which extends from the respective sidewalls 20 and overlie the grooves 27 of the adjacent components 23 to jointly form a shroud-like structure which confines the respective pushers 24 to movements in the corresponding grooves 27 and along straight path portions between such grooves and the sockets 30 in the corresponding bearings 16.

It is possible to modify the wringing apparatus by providing moving means 7 for each of the wringing members 4, 5 or 4, 105. The illustrated embodiments, wherein the wringing member 5 or 105 is rotatable about a fixed axis) is preferred at this time because this contributes to simplicity and compactness of the wringing apparatus. Furthermore, and referring to FIG. 2, it is simpler to establish a torque transmitting connection (11) between a prime mover (9) and a wringing member (5) which is rotatable about a fixed axis.

Though it is possible to provide a manually operated switch 12 for completion of the circuit of the motor 9 or 109, the provision of a switch which can complete the motor circuit in automatic response to movement of the member 4 toward or all the way to the extended position, and which automatically opens the motor circuit in response to movement of the member 4 back to the retracted position, is preferred because the attendant need not be concerned with the means for rotating the wringing members 4, 5 or 4, 105 in the course of the actual wringing operation. Thus, one hand of the person in charge will grasp the handle or lever 8 and the other hand will manipulate the implement which includes or carries the commodity 2, or such other hand will pull a tip of a freshly washed, rinsed and/or disinfected commodity into the space or passage between the members 4, 5 before the one hand causes the lever 8 to initiate a movement of the member 4 toward the member 5 or 105 and to start the motor 9 or 109.

The structure of FIG. 5 will be resorted to if the space within the housing 6 is at a premium and/or when the designer of the wringing apparatus is particularly concerned with compactness of the apparatus and/or when the designer wishes to shield the motor 109 from contaminants and/or other undesirable influences.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. Apparatus for wringing mops and other wet commodities comprising a first rotary wringing member; a second rotary wringing member; means for rotating at least said first wringing member; and means for moving at least one of said wringing members relative to the other of said wringing members between a retracted position in which said members permit a commodity to pass between them and an extended position in which said members define a nip for and expel moisture from a commodity which is caused to pass between said members in response to rotation of said first wringing member, said moving means comprising at least one elongated flexible pusher having a first portion connected to said at least one member and a second portion, and at least one gathering element fixedly connected with the second portion of said at least one pusher and rotatable in a first direction to gather said at least one pusher and to permit movement of said at least one wringing member to said retracted position and in a second direction to dispense said at least one pusher whereby the at least one pusher moves said at least one wringing member to said extended position.

2. The apparatus of claim 1, wherein said wringing members are rotatable about substantially parallel axes and said at least one wringing member is movable substantially radially of said other member.

3. The apparatus of claim 1, further comprising means for confining said at least one pusher to movement along a predetermined path, at least during rotation of said at least one gathering element in said second direction.

4. The apparatus of claim 3, wherein said at least one pusher consists of elastomeric material and stores energy by overcoming the resistance of said at least one wringing member to movement toward said extended position during rotation of said at least one gathering element in said second direction.

5. The apparatus of claim 3, wherein said confining means comprises a shroud adjacent said at least one gathering element and overlying the collected pusher.

6. The apparatus of claim 5, wherein said at least one gathering element has an arcuate peripheral surface for gathering of said at least one pusher and said shroud is adjacent said peripheral surface, at least while said at least one gathering element rotates in said second direction.

7. The apparatus of claim 6, wherein said path includes an arcuate portion which is defined by said peripheral surface and a substantially straight portion which is defined by said shroud.

8. The apparatus of claim 7, wherein said at least one rotary wringing member comprises a roller having a shaft and a bearing for said shaft, said first portion of said at least one pusher engaging said bearing to move said bearing along said straight portion of said path in response to rotation of said at least one gathering element in said second direction.

9. The apparatus of claim 3, wherein said at least one gathering element constitutes at least a portion of a disc.

10. The apparatus of claim 3, wherein said at least one gathering element is sector-shaped.

11. The apparatus of claim 3, wherein said at least one gathering element has an arcuate peripheral surface and said confining means includes a groove in said peripheral surface to receive said at least one pusher in the retracted position of said at least one wringing member.

12. The apparatus of claim 11, wherein said groove has a depth sufficient to receive at least the major part of the at least one pusher between the first and second portions of said pusher in retracted position of said at least one wringing member.

13. The apparatus of claim 3, wherein said gathering element has a component arranged to gather the pusher and extending along an arc of approximately 90°.

14. The apparatus of claim 3, wherein said at least one wringing member includes a roller having a first end and a second end, a shaft extending beyond each end of said roller, and a bearing for said shaft at each end of said roller, said moving means comprising two gathering elements and two pushers each connected to one of said gathering elements and each engaging one of said bearings.

15. The apparatus of claim 3, wherein said first wringing member comprises a roller which is rotatable about a fixed axis, said rotating means comprising means for driving said roller.

16. The apparatus of claim 3, further comprising a housing for said wringing members, said rotating means and said moving means, said rotating means comprising an electric motor and a portable source of electrical energy provided in said housing and in circuit with said motor.

17. The apparatus of claim 16, wherein said energy source comprises at least one battery.

18. The apparatus of claim 16, further comprising means for completing said circuit including a switch and means for actuating said switch in response to movement of said at least one wringing member between said extended and retracted positions.

19. The apparatus of claim 3, further comprising a liquid confining receptacle and a housing for said wringing members, said rotating means and said moving means, said housing being positionable on said receptacle and defining a passage which extends between said wringing members in the retracted position of said at least one wringing member and is sufficiently wide to permit movement of a wet commodity from and into said receptacle.

20. The apparatus of claim 19, wherein said receptacle is a bucket having an open top and said housing is positionable on the open top of said bucket.

21. The apparatus of claim 1, further comprising means for biasing said at least one wringing member to said retracted position.

22. The apparatus of claim 1, wherein said rotating means includes means for driving said first wringing member in a direction such that a commodity in said nip is caused to move upwardly in response to rotation of said first member.

23. The apparatus of claim 1, further comprising means for intercepting moisture which is expelled from a commodity in said nip in the extended position of said at least one wringing member and while said first wringing is rotated by said rotating means.

24. The apparatus of claim 23, wherein said intercepting means is located beneath at least one of said wringing members.

* * * * *